US009599326B2

(12) United States Patent
Hanke et al.

(10) Patent No.: US 9,599,326 B2
(45) Date of Patent: Mar. 21, 2017

(54) LIGHTING SYSTEM

(71) Applicant: OASE GmbH, Hörstel-Riesenbeck (DE)

(72) Inventors: Andreas Hanke, Osnabrück (DE); Rainer Schwinden, Münster (DE)

(73) Assignee: OASE GmbH, Hörstel-Riesenbeck (DE)

( * ) Notice: Subject to any disclaimer, the term of this patent is extended or adjusted under 35 U.S.C. 154(b) by 0 days.

(21) Appl. No.: 14/395,069

(22) PCT Filed: Apr. 16, 2013

(86) PCT No.: PCT/EP2013/001123

§ 371 (c)(1),
(2) Date: Sep. 7, 2015

(87) PCT Pub. No.: WO2013/156146

PCT Pub. Date: Oct. 24, 2013

(65) Prior Publication Data

US 2015/0362166 A1 Dec. 17, 2015

(30) Foreign Application Priority Data

Apr. 18, 2012 (DE) ..... 20 2012 003 936 U

(51) Int. Cl.
*F21V 31/00* (2006.01)
*F21V 23/00* (2015.01)
(Continued)

(52) U.S. Cl.
CPC ..... *F21V 23/009* (2013.01); *F21K 9/20* (2016.08); *F21S 2/005* (2013.01); *F21V 21/30* (2013.01); *F21V 23/001* (2013.01); *F21V 23/008* (2013.01); *F21V 23/023* (2013.01); *F21V 23/026* (2013.01); *F21V 23/0435* (2013.01);
(Continued)

(58) Field of Classification Search
CPC .... F21V 23/001; F21V 23/008; F21V 23/009; F21V 23/023; F21V 23/026; F21V 23/0435; F21V 31/00; F21V 29/004; F21V 29/507; F21V 21/30
See application file for complete search history.

(56) References Cited

U.S. PATENT DOCUMENTS 7,494,244 B1 2/2009 Van Diep
2005/0248944 A1 11/2005 Sloan
(Continued)

FOREIGN PATENT DOCUMENTS

EP 2 388 514 A2 11/2011

*Primary Examiner* — Thomas M Sember
(74) *Attorney, Agent, or Firm* — Gudrun E. Huckett

(57) ABSTRACT

The invention relates to a lighting system comprising at least one light module (3), preferably a plurality of light modules (3), which can be installed in e.g. pool walls of swimming baths or footpaths and have at least one LED (4), wherein the light modules are each connected by means of at least one system cable (2) to a common central and bus-capable controller (1) and can be controlled thereby, wherein the system cable (2) is provided for power supply to the light modules (3) and for control of the respective light modules (3) from the controller (1), and wherein in each case a light module (3) which can be positioned by means of an associated system cable (2) remote from the controller (1) has a housing, which is in particular watertight, in which driver means are disposed for supplying power to the LED (4).

13 Claims, 5 Drawing Sheets

(51) Int. Cl.

| | |
|---|---|
| ***F21V 29/00*** | (2015.01) |
| ***F21S 2/00*** | (2016.01) |
| ***F21V 21/30*** | (2006.01) |
| ***F21V 23/02*** | (2006.01) |
| ***F21V 23/04*** | (2006.01) |
| ***H05B 37/02*** | (2006.01) |
| ***F21V 29/507*** | (2015.01) |
| *F21W 111/023* | (2006.01) |
| *F21W 121/02* | (2006.01) |
| *F21W 131/401* | (2006.01) |
| *F21Y 101/00* | (2016.01) |

(52) U.S. Cl.

CPC ..... *F21V 29/004* (2013.01); *F21V 29/507* (2015.01); *F21V 31/00* (2013.01); *H05B 37/0254* (2013.01); *F21W 2111/023* (2013.01); *F21W 2121/02* (2013.01); *F21W 2131/401* (2013.01); *F21Y 2101/00* (2013.01); *F21Y 2113/13* (2016.08); *F21Y 2115/10* (2016.08)

(56) References Cited

U.S. PATENT DOCUMENTS

| | | | |
|---|---|---|---|
| 2006/0023454 | A1 | 2/2006 | Koren |
| 2007/0279900 | A1 | 12/2007 | Bauer |

LIGHTING SYSTEM

BACKGROUND OF THE INVENTION

The present invention concerns a lighting system with at least one light module, preferably with a plurality of light modules. The one or more light modules are installable, for example, in the walls of swimming pools (under water) or walkways.

Up to now, the light modules in particular in the underwater area have conventionally always been provided with LEDs that, in addition to the associated power supply and the drivers required for this purpose, comprise a controller at the same time. In operation, the driver means as well as the controller produce heat that must be dissipated. Moreover, in particular for wall installations, large dimensions of the light modules are required due to the required mounting space and the dissipation of large heat quantities.

It is the object of the present invention to design light modules of a lighting system in a more compact configuration.

SUMMARY OF THE INVENTION

The object is solved by a lighting system comprising at least one light module, preferably a plurality of light modules, that are installable in walls of swimming pools or in walkways and that comprise at least one LED, wherein the light modules each are connected by at least one system cable with a common central and bus-capable controller and are controllable by it, wherein the system cable is provided for supplying power to the light modules and for controlling the respective light modules by the controller and wherein each light module, which is positioned remote from the controller by means of the corresponding system cable, comprises a housing which is in particular water-tight and in which driver means for energy supply of the LEDs are arranged. Advantageous embodiments of the invention can be taken from the dependent claims as well as the following description.

A lighting system according to the invention comprises at least one light module, preferably a plurality of light modules, wherein the one or more light modules can be installed, for example, in pool walls of swimming pools or walkways and comprise at least one LED. The light modules of the lighting system according to the invention are each connected by means of at least one system cable with a common central and bus-capable controller of the lighting system and controllable by it, wherein the system cable is provided for power supply of the light modules and for control (respectively) of the respective light modules by means of the controller and wherein each light module, positionable remote from the controller by means of the corresponding system cable, comprises a housing that is in particular water-tight and in which driver means for energy supply of the LED are arranged. A bus-capable controller is to be understood as a controller that comprises a bus interface and is controllable by means of a system bus, for example, a CAN bus or DMX bus.

In the lighting system according to the invention, the light modules are of a smaller size as a result of the central controller. The light modules are in particular configured completely without controller. In a light module, only the driver means required for providing the energy supply are present as well as optionally monitoring means such as temperature sensors that can be scanned via the system cable by the controller. For this purpose, a two-core system cable whose current-carrying wire can be impressed with a corresponding signal may be sufficient. The system cable can be provided at both ends with plugs for connection with the controller and the light module or at one end can be fixedly connected with the controller or the light module and then be provided with a plug contact at the other end. All control tasks are triggered or carried out remote from the light modules in the controller or by means of control means connected thereto.

By eliminating a controller within the light module, less waste heat is produced therein, the housing can be designed to be smaller and therefore can be installed more easily in the walls of swimming pools, floors or the like.

For supplying power to the LEDs in the light modules, the latter are connected by means of the system cable with an associated connector at the controller. At the same time, the controller can be supplied with power from a central transformer by means of a supply cable, which preferably can be designed identically to the system cable.

Preferably, the central controller comprises a data bus interface by means of which it is connectable with an electronic data processing device such as a PC, a tablet computer, a smart phone or a compact control unit. In the compact control unit, fixed programs are stored which can be selected, for example, by means of a remote control. In such a case, in particular for an underwater arrangement of the controller, a part of the compact control unit is inconspicuously positionable on a stand, for example, in a flower bed. By means of a remote control, the individual programs can then be selected and retrieved. By means of the data connection, the controller is supplied appropriately with information based on which the light modules with their LED lights can be controlled accordingly. As an alternative or as a supplement, by means of a connection to a PC or another electronic data processing device, a freely programmable control action can be realized in which a user can individually adjust the control action of the light modules. Such an application is, for example, designed as an app for a tablet computer. A compact control unit can also be present in the form of an app on a tablet computer or smart phone in order to enable an operating comfort as high as possible and as modern as possible.

The advantages of the system according to the invention reside in that only a central controller is required. The individual light modules must therefore contain only possibly present LED drivers or LED power components and do not require their own LED controller. On the one hand, this provides immense cost savings in producing the module and, on the other hand, leads to the already described more compact configuration of the light modules.

In an embodiment with a compact control unit, the latter comprises in particular a control program that can be retrieved by a remote control, whose signal causes the controller to control the light modules in the pre-programmed way. In this context, the control program can start in particular a query on the number and types of LED lights which are connected to the controller and can select or modify possibly present matching programs or emit a signal that a number of light modules is missing or is defective.

By means of an adapter which is interposed between at least two light modules and the controller and which enables the connection of several light modules to a single controller output, the system can be expanded to a greater number of light modules.

Advantageously, a circuit board of the light module provided with an LED is arranged immediately on the metallic housing thereof and in such a way that in operation the produced heat is dissipated from the circuit board into the housing and the circuit board can be cooled in this way. Accordingly, possible cooling bypasses within the housing can be eliminated and the seal-tightness of the housing can be ensured more easily.

In particular, the central controller as well as the light modules are provided with an ingress protection IP68 according to DIN 40050 by appropriate precise fit, sealing means, and sealing planes of the plug connections. Accordingly, the corresponding lighting system can also be arranged in the underwater area.

For orientation and better adjustability of the lighting system, particularly a part of the light module which comprises the LEDs can be pivotably supported relative to a base of the light module.

Preferably, a light module of a system according to the invention comprises three RGB-LEDs uniformly distributed circumferentially. A plurality of lighting effects can be covered with this number of LEDs. The uniform distribution across the circuit board or along a housing rim, for example, ensures at the same time the uniform dissipation of possibly produced operating heat. As an alternative or in addition, the system in the light module may also comprise clusters of LEDs of different color, which preferably provide at least the primary colors, along the circumference of a cutout to be positioned discretionarily within the light module. An individual such cluster is comprised, for example, of at least three LEDs that are positioned as closely as possible adjacent to each other, wherein one is embodied to be red, one green, and one blue. These LEDs can be configured to be individually controllable or by means of the corresponding one or more drivers commonly controllable by the controller, depending on the configuration. Of course, a light module can also be furnished with LEDs of only one color.

Cooling of the circuit board is in particular optimized when the circuit board is arranged indirectly, by means of a heat-conductive layer, or directly on the metallic housing of the corresponding light module in such a way that the heat produced in operation is dissipated from the circuit board into the housing and the circuit board can be cooled in this way. For a particularly flat configuration of the housing it is advantageous in this context when the circuit board is provided on a bottom side of the cooling module that is provided with cooling ribs and positioned opposite a topside provided with a pane. Since the light module has a significantly smaller height compared to the width, cooling by means of the bottom side by means of cooling ribs is particularly efficient. In this way, in light modules provided with diodes that are embodied, for example, as RGB diodes a luminous flux of a total of 200-250 lumen can be achieved without a problem.

In a further advantageous embodiment of the lighting system, the light module comprises a central opening for accommodating a nozzle or directly a central nozzle which then also passes through possible covers or panes of the light modules. The lighting system can thus be supplemented to, or can be converted to, a fountain.

BRIEF DESCRIPTION OF THE DRAWINGS

Further advantages and details of the invention can be taken from the following figure description. The schematic illustrations of the Figures show in.

DESCRIPTION OF PREFERRED EMBODIMENTS

Same or similarly acting parts are provided—inasmuch as useful—with identical reference numbers. Individual technical features of the embodiments described in the following can also lead to further embodiments according to the invention with the features of the afore described embodiments.

Figure 1:
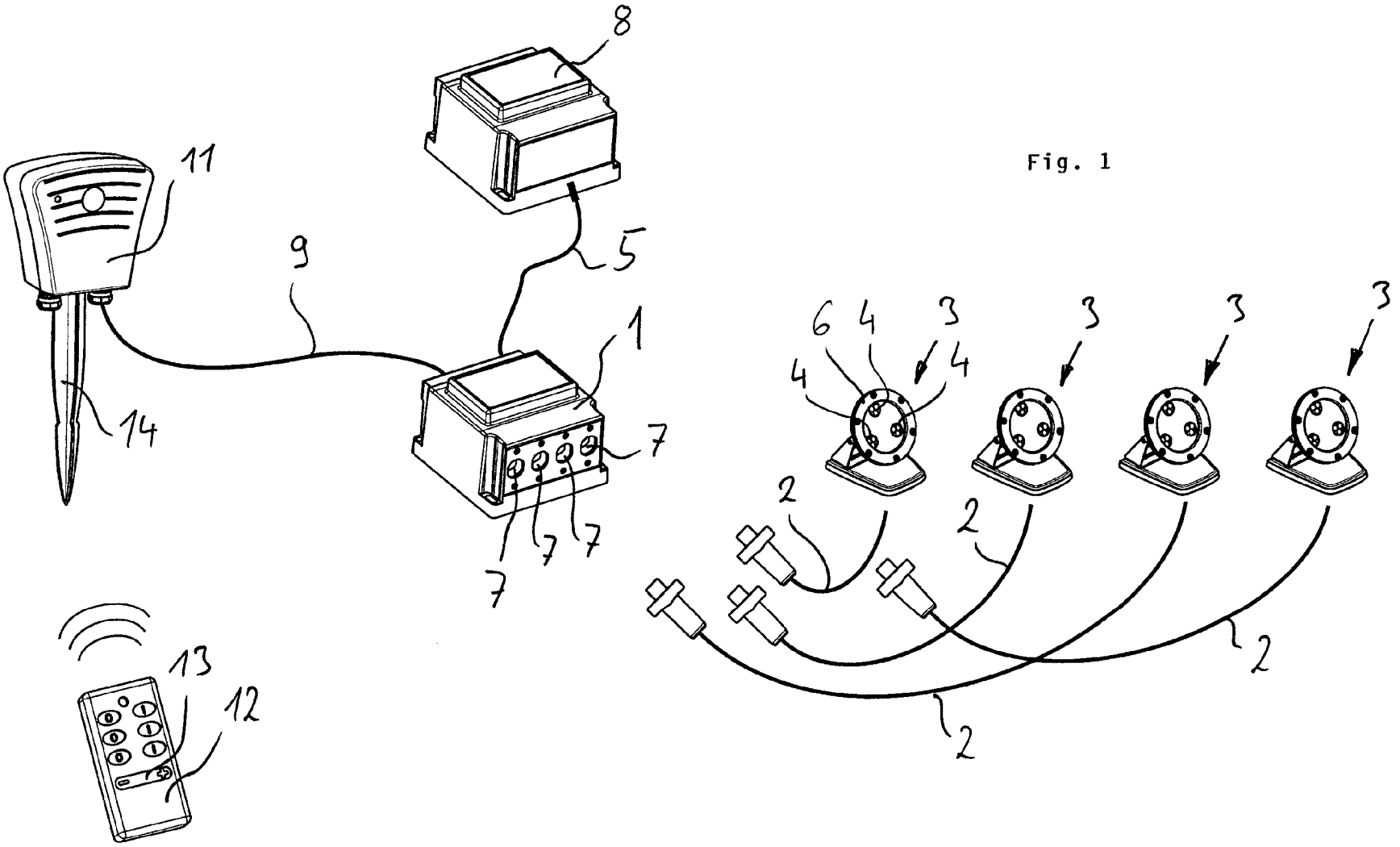
FIG. 1 an article according to the invention.

An article according to the invention according to FIG. 1 comprises a central controller or LED controller 1 that is provided by means of system cables 2 with four light modules 3 in the present case. Each light module 3 comprises three RGB diodes 4 which are uniformly arranged along the circumference of the circular light unit of the light module. Alternatively, instead of an RGB diode, a cluster with at least three diodes of the colors red, green, and blue can be also employed. By means of a screwed-on metal ring 6, a glass pane, not illustrated in detail, is screwed on tightly onto the further housing of the light module for sealing purposes. Each light module 3 has correlated therewith a controller output 7 into which the respective system cable 2 can be inserted in a seal-tight way so that the entire arrangement can be used long-term under water. A transformer 8 serves as a power supply for the controller 1 by means of supply cable 5 and thus indirectly also as a power supply of the light modules 3.

As also in the other embodiments, the system cables are shown in a position prior to connecting the light modules 3 to the controller 1.

By means of a data bus interface, a data connection 9 is connected with a compact control unit 11. In the latter, a series of predefined programs is permanently stored in an associated storage means. These programs can be retrieved by means of a manual sender or a remote control 12. For example, three different programs are provided that can be switched on or switched off and can be varied with respect to luminosity by means of a plus/minus pivot lever 13. For an inconspicuous arrangement, the compact control unit 11 is provided, for example, with a stake 14 that can be submerged in the soil so that the compact control unit can be arranged inconspicuously, for example, within a flower bed adjacent to a pond. The compact control unit 11 has an appropriate receiving unit for receiving the data signals that are emitted by the manual sender.

The four light modules 3 are designed free of a controller, i.e., they comprise only means for power supply and for operating the light diodes with regard to their power supply.

All other control functions are carried out remote from the light modules 3 by the compact control unit or the LED controller.

Figure 2:
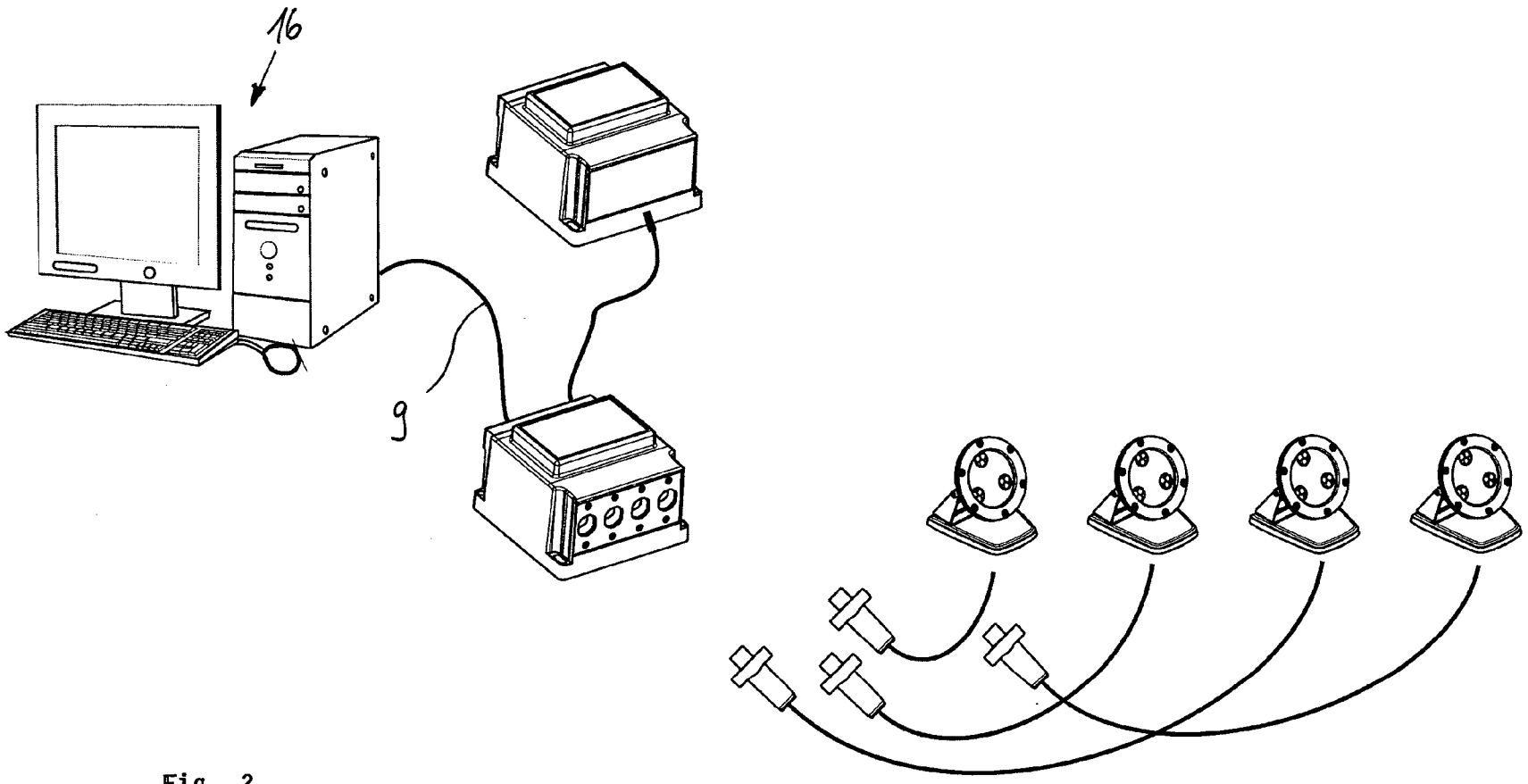
FIG. 2 the article of FIG. 1 in a further configuration.

In the embodiment of FIG. 2, a PC 16 is connected to the data cable 9 instead of a compact control. Instead of a conventional PC, of course another electronic data processing device can be provided also. In particular, this is a portable electronic data processing device such as a tablet computer or a notebook which is provided with a program for programming light effects and control actions for the light modules. Also, the data cable 9 can be provided, for example, with a Bluetooth or WiFi interface by means of which a wireless programming of the controller can be enabled. The controller itself can also have corresponding means by means of which a wireless activation and programming or control thereof is enabled.

Figure 3:
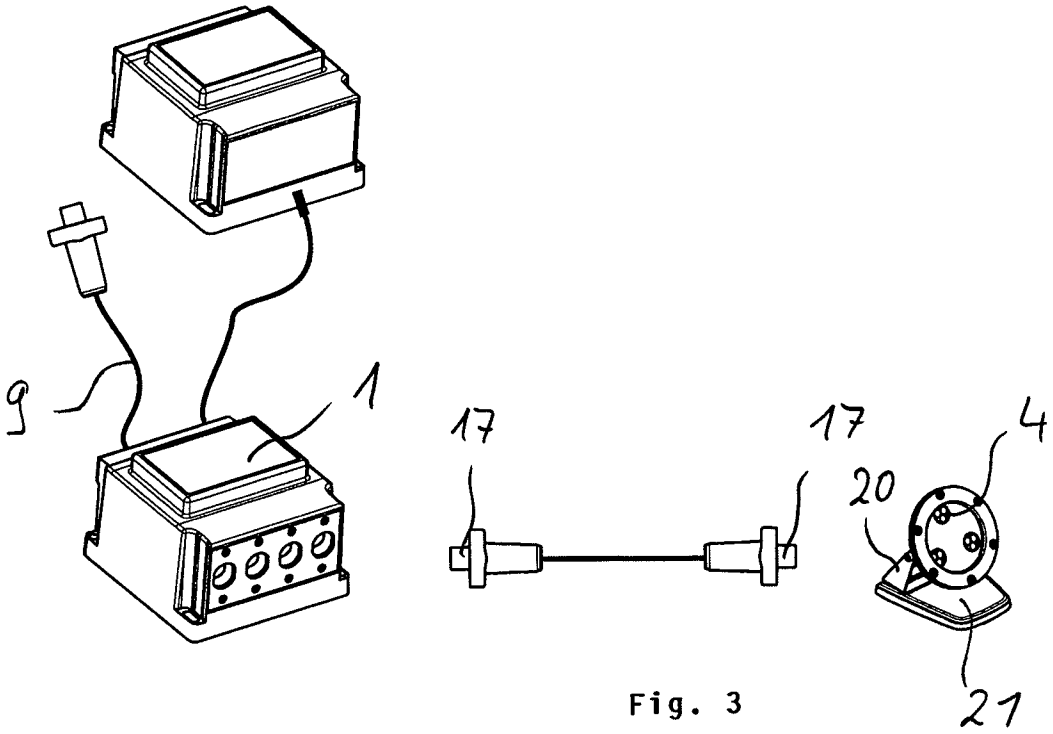
FIG. 3 a modification of the article of FIG. 1.

In the embodiment of FIG. 3, the controller is provided for controlling only one light module with also, again, three RGB-LEDs. As in the further embodiments, a part of the light module which comprises the LEDs 4 is supported pivotably by means of a bracket 20 relative to the base 21.

By means of the data cable 9, corresponding compact control units or programmable programs can access the LED controller 1.

Advantageously, the employed system cables have identical interfaces relative to the light modules and the LED controller so that a simple operation is ensured. Likewise, the plugs 17 are of identical design.

Figure 4:
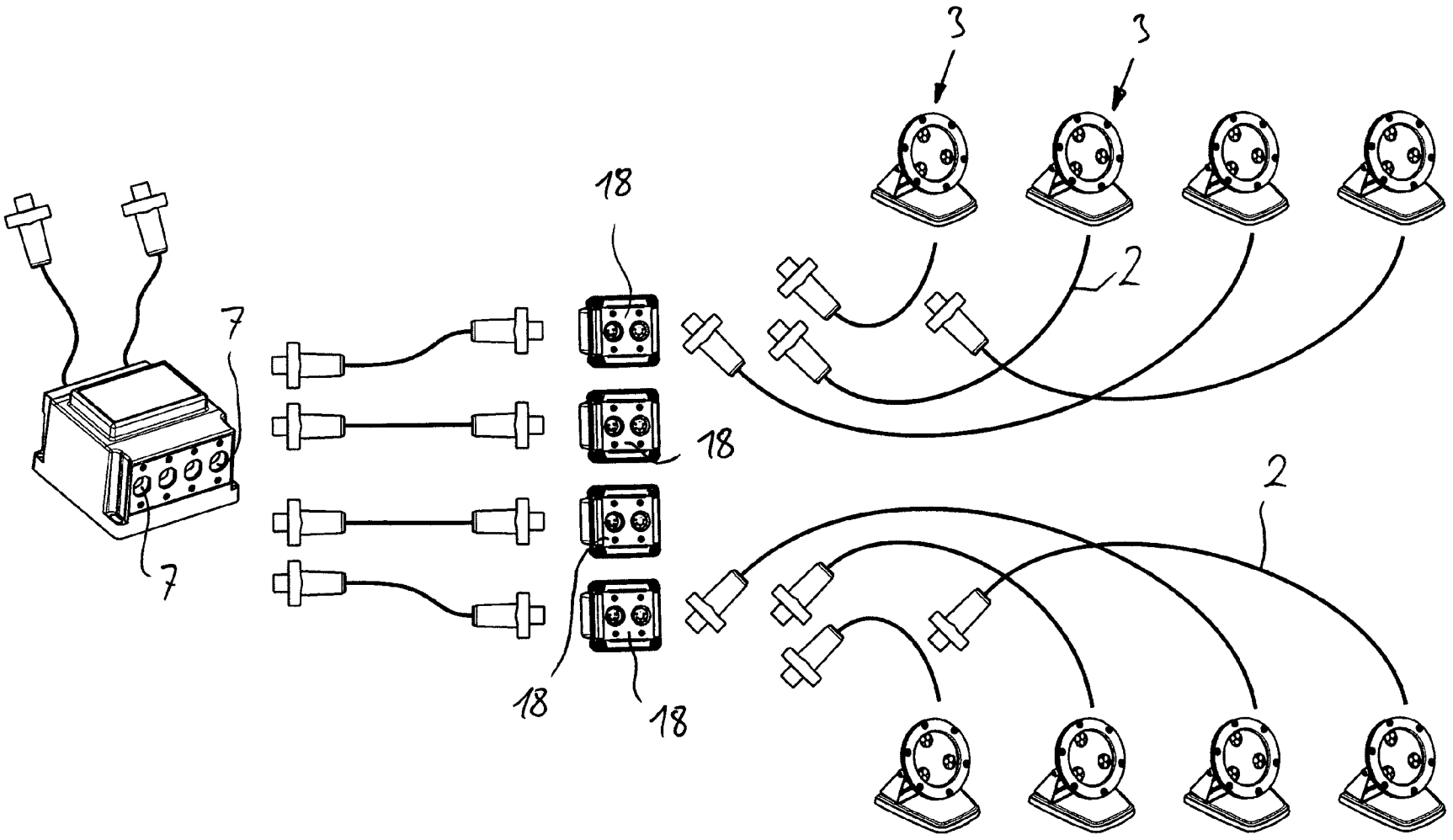
FIG. 4 the article of FIG. 1 in an expanded variant.

The embodiment of FIG. 4 illustrates the use of distributor boxes or adapters 18 through which more than one light module, in the illustrated example, two light modules 3, respectively, can be arranged at a controller output 7. For this purpose, the adapters 18 duplicate or multiply the connectors and provide, similar to a multi-outlet power strip, a plurality of further connectors. Expediently, these are again identical plug contacts so that the system cables 2 can be used, independent of their positioning, between adapter and light module or adapter and controller.

The controller moreover can perform remote servicing or remote retrieval of the light modules with regard to the temperature, for example. Calibration of the lights is moreover possible by retrieving the driver statuses.

Figure 5:
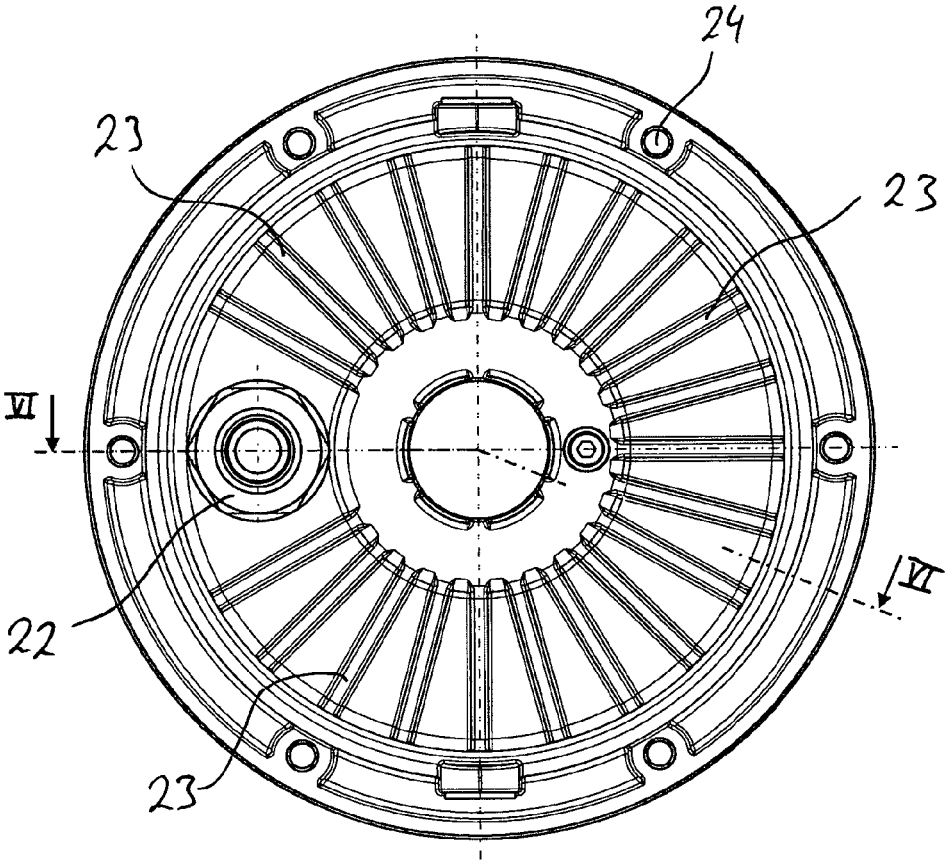
FIG. 5 a bottom view of a light module of an article according to the invention.
Figure 6:
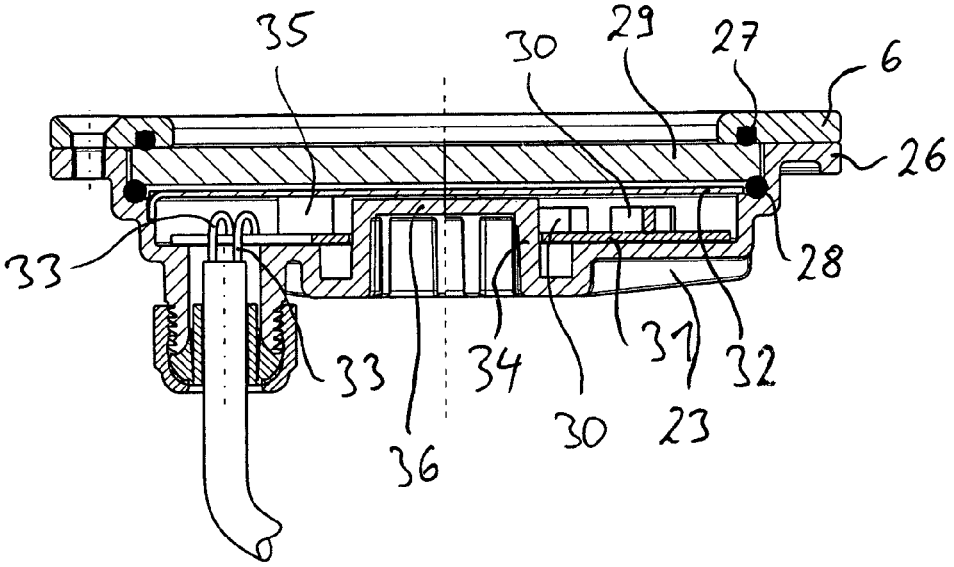
FIG. 6 a section along VI-VI according to FIG. 5.

FIG. 5 discloses a bottom view of a part of a light module according to the invention with a connector 22 for a system cable. This system cable according to FIG. 6 is connected fixedly with the light module and has, on the end which is not illustrated, a plug for connection to a controller or adapter.

Moreover, a plurality of cooling ribs 23 can be seen which serve for discharging the heat that is produced by the LEDs or the driver means to the exterior of the housing. Fastening means 24 serve for screwing on the metal ring 6 belonging to the housing to the housing bottom side or the bottom part 26 of the housing. By means of sealing rings 27 and 28 a pane 29 is seal-tightly secured between the metal ring 6 and the housing bottom part or the bottom side of the housing 26. On the inner side of the bottom side 26 of the housing a printed board or circuit board 31 is arranged by means of a heat-conductive paste. The circuit board comprises three RGB-LEDs 30 whose light passes to the exterior through cutouts, not illustrated in detail, of a cover plate 32 functioning as a cover and through the pane 29. Driver means 35 are arranged on the circuit board 31 itself. A power supply is realized by means of wires 33 provided by the system cable.

By means of a support sleeve of the housing bottom part which is recessed within the bottom side, a wall 34 projects into an area above the printed board 31 so that heat can be dissipated even from the area above the printed board.

At the same time, by removing the top 36 and extending the walls 34, a central opening can be produced that then also passes through the pane 29 and the cover plate and in particular can serves for arranging a nozzle. The metallic elements of the housing (ring and bottom side) are made of a die cast material that is steel-based and dissipates heat particularly well.

What is claimed is:

1. A lighting system comprising:

at least one light module comprising a water-tight light module housing, at least one LED arranged in the water-tight light module housing, and a driver arranged in the water-tight light module housing for energy supply of the at least one LED, wherein the at least one light module comprises no controller for the at least one LED;

at least one system cable;

a central and bus-capable common controller comprising a water-tight controller housing, wherein the at least one light module is connected by the at least one system cable to the common controller and wherein the common controller is configured to control the at least one light module via the at least one system cable;

wherein the at least one system cable is configured to supply power to the at least one light module;

wherein the at least one light module is positioned remote from the common controller due to the at least one system cable;

wherein the water-tight light module housing and the water-tight controller housing each have an ingress protection IP68 according to DIN 40050, wherein the internal volume of the housing is protected against particulate ingress and is protected against water ingress for continuous submersion in water to an extent greater than required to prevent water ingress at an immersion depth of at least 150 mm above a highest point of the housing and at least 1 meter below the surface of the water for a lowest point of the housing for at least 30 minutes; and wherein a connection of the water-tight light module housing and the water-tight controller housing through the at least one system cable is seal-tight so that the lighting system is configured to be used under water.

2. The lighting system according to claim 1, further comprising a central transformer and a supply cable connecting the common controller to the central transformer, wherein the central transformer supplies power to the common controller via the supply cable.

3. The lighting system according to claim 1, wherein the common controller is configured to be connected by a data bus interface with an electronic data processing device or with a compact control unit.

4. The lighting system according to claim 3, wherein the compact control unit connected to the data bus interface comprises at least one control program which is retrievable by a remote control of the lighting system, wherein a signal of the remote control causes the common controller to control the at least one light module in a pre-programmed mode.

5. The lighting system according to claim 1, further comprising an adapter interposed between the at least one light module and the common controller, wherein the adapter enables the connection of several of said at least one light module to a controller output of the common controller.

6. The lighting system according to claim 1, wherein the at least one light module further comprises a circuit board arranged in the housing and provided with the at least one LED.

7. The lighting system according to claim 6, wherein the circuit board is arranged immediately on the housing that is a metallic housing such that heat produced in operation of the at least one light module is dissipated from the circuit board into the metallic housing and the circuit board is cooled thereby.

8. The lighting system according to claim 6, wherein the circuit board is indirectly arranged on the housing that is a metallic housing by interposing a heat-conductive layer such that heat produced in operation of the at least one light module is dissipated from the circuit board into the metallic housing and the circuit board is cooled thereby.

9. The lighting system according to claim 6, wherein the circuit board is arranged on a bottom side of the at least one light module, wherein the bottom side is provided with cooling ribs and is positioned opposite a topside provided with a pane of the at least one light module.

10. The lighting system according to claim 9, wherein the at least one light module comprises a cover plate that covers the circuit board and that is arranged between the pane and the circuit board, wherein the circuit board is annular.

11. The lighting system according to claim 1, wherein the at least one light module comprises a part that, is pivotably supported relative to a base of the at least one light module.

12. The lighting system according to claim 1, wherein the at least one light module comprises three RGB-LEDs distributed uniformly circumferentially or comprises LED clusters with LEDs of different colors.

13. The lighting system according to claim 1, wherein the at least one light module comprises a central opening for receiving a nozzle or comprises a central nozzle.

* * * * *